US008979601B2

(12) United States Patent
Schmidt et al.

(10) Patent No.: US 8,979,601 B2
(45) Date of Patent: Mar. 17, 2015

(54) ELECTRIC CONNECTING TERMINAL AS WELL AS METHOD AND DEVICE FOR PRODUCING AN ELECTRIC CONNECTING TERMINAL

(75) Inventors: Helge Schmidt, Speyer (DE); Uwe Bluemmel, Hockenheim (DE); Jochen Brandt, Stoedtlen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 47 days.

(21) Appl. No.: 13/818,071

(22) PCT Filed: Aug. 9, 2011

(86) PCT No.: PCT/EP2011/063683

§ 371 (c)(1),
(2), (4) Date: Feb. 20, 2013

(87) PCT Pub. No.: WO2012/025372

PCT Pub. Date: Mar. 1, 2012

(65) Prior Publication Data

US 2013/0157524 A1 Jun. 20, 2013

(30) Foreign Application Priority Data

Aug. 23, 2010 (DE) ..... 10 2010 039 655

(51) Int. Cl.
*H01R 4/10* (2006.01)
*H01R 4/18* (2006.01)
*H01R 43/16* (2006.01)

(52) U.S. Cl.
CPC ..... *H01R 4/18* (2013.01); *H01R 4/188* (2013.01); *H01R 43/16* (2013.01)
USPC ..... 439/882

(58) Field of Classification Search
USPC ..... 439/877–882, 421, 424; 174/84 C, 90
See application file for complete search history.

(56) References Cited

U.S. PATENT DOCUMENTS

| | | | |
|---|---|---|---|
| 2,800,638 | A | 7/1957 | Hammell |
| 3,293,355 | A | 12/1966 | Gropp et al. |
| 3,522,577 | A | 8/1970 | Zak |

(Continued)

FOREIGN PATENT DOCUMENTS

| | | |
|---|---|---|
| CH | 335319 | 6/1954 |
| DE | 2435412 A1 | 6/1975 |

(Continued)

OTHER PUBLICATIONS

International Preliminary Report on Patentability issued by The International Bureau of WIPO, Geneva, Switzerland, dated Feb. 26, 2013, for related International Application No. PCT/EP2011/063683; 4 pages.

(Continued)

*Primary Examiner* — Jean F Duverne
(74) *Attorney, Agent, or Firm* — Faegre Baker Daniels LLP

(57) ABSTRACT

An electric connecting terminal for connecting to an electrical conductor structure is described, with a serration arrangement, comprising a plurality of serration structures, for cutting into the electrical conductor structure being provided in a conductor-side section of the electric connecting terminal. In this case the serration arrangement has a gradient-shaped sharpness profile formed by heapings of material produced in an embossing process.

12 Claims, 6 Drawing Sheets

(56) References Cited

U.S. PATENT DOCUMENTS

| | | | | | |
|---|---|---|---|---|---|
| 3,549,786 | A | | 12/1970 | Kuo | |
| 3,735,331 | A | | 5/1973 | O'Donnell et al. | |
| 3,852,702 | A | | 12/1974 | Dowling | |
| 3,947,082 | A | * | 3/1976 | Bender | 439/421 |
| 3,989,339 | A | * | 11/1976 | Haitmanek | 439/421 |
| 5,385,483 | A | * | 1/1995 | Lin | 439/424 |
| 5,522,739 | A | * | 6/1996 | Axelsson | 439/730 |
| 7,210,958 | B1 | | 5/2007 | Jacques et al. | |
| 8,303,354 | B2 | * | 11/2012 | Ootsuka et al. | 439/877 |
| 8,519,267 | B2 | * | 8/2013 | Peters et al. | 174/77 R |

FOREIGN PATENT DOCUMENTS

| | | | |
|---|---|---|---|
| DE | 2539323 | A1 | 3/1976 |
| GB | 1482831 | | 8/1977 |
| WO | WO 88/08625 | | 11/1988 |

OTHER PUBLICATIONS

International Search Report and Written Opinion issued by the European Patent Office, dated Aug. 31, 2011, for related International Application No. PCT/EP2011/063683; 11 pages.

Office Action dated Jul. 11, 2011 issued by the German Patent and Trademark Office for related Application No. 10 2010 039 655.9; 5 pages.

* cited by examiner

ELECTRIC CONNECTING TERMINAL AS WELL AS METHOD AND DEVICE FOR PRODUCING AN ELECTRIC CONNECTING TERMINAL

Electric connecting terminal and also method and device for producing an electric connecting terminal The invention relates to an electric connecting terminal with a serration arrangement having a gradient-shaped sharpness profile. Further, the invention relates to a production method for such an electric connecting terminal.

Electrical conductors are frequently terminated at their free ends with connection pieces which permit contacting of the conductor with corresponding contact partners. For this, inter alia connecting terminals are used which permit solder-free connection to the conductor structure. These terminals, which are also known as crimp connection terminals, are typically manufactured from a metal sheet by means of a punching process. In such case, a conductor-side section of the connecting terminal has at least one tab which is bent around the conductor and then is crimped therewith for the purposes of mechanical and/or electrical connection. In the case of electrical conductor structures which are coated with an insulating layer, such as a thin enamel layer or a parasitic oxide layer, the disturbing insulating layer has to be removed or broken through in order to produce sufficient electrical contact between the connecting terminal and conductor structure. Connecting terminals in which the surface which contacts the conductor has special sharp-edged serration structures are used for this. Upon crimping of the connecting terminal, the parasitic insulating layer is broken through by the serration structures cutting into the metallic conductor. By means of appropriate crimping, good extension and associated galling of the materials involved is permitted, which in turn achieves good electrical contacting. The transition resistances prove to be stable long-term over the lifetime, in particular for aluminium conductors and hard copper conductors with small cross-sections.

The use of sharp-edged serrations however also leads to undesirable mechanical weakening of the relevant conductor, since the conductor cross-section is reduced at the relevant points by the serration structures cutting in. This effect proves particularly harmful in the case of conductors made from brittle materials, such as aluminium. Further, the use of such a connecting terminal may also be unfavourable in the case of conductors which are constructed from a plurality of thin strands. In this case, the sharp-edged serrations can effect severing of individual conductor strands.

A conventional connecting terminal is typically produced by means of a punching process, the serrations in a subsequent "ploughing" process being produced outside the punch. In this process, a plurality of knife-like "ploughing" structures arranged next to one another are drawn across the conductor contact surface of the connecting terminal transversely to the direction of insertion of the cable, in order to produce groove-like structures with symmetrical heapings of material.

Departing from this prior art, it is an object of the invention to provide an electric connecting terminal which permits both sufficient electrical connection and sufficient mechanical connection between the connecting terminal and conductor, and in addition is inexpensive to produce. This object is achieved by an electric connecting terminal according to Claim 1 and also by a production method for an electric connecting terminal according to Claim 3. Further, the object is achieved by a device according to Claim 8. Further advantageous embodiments of the invention are set forth in the dependent claims.

According to the invention, an electric connecting terminal for connecting to an electrical conductor structure is provided which comprises a serration arrangement, comprising a plurality of serration structures, for cutting into the electrical conductor structure in a conductor-side section. The serration arrangement in this case has a gradient-shaped sharpness profile formed by heapings of material produced in an embossing process. The gradient-shaped profile of the serration arrangement means that a conductor structure in the conductor-side region of the clamping connection is cut into only slightly, in order to prevent mechanical weakening of the conductor structure in this region. On the other hand, the conductor structure in the contact-side region of the clamping connection is cut into more deeply, in order to ensure sufficient electrical contact. This is advantageous in particular in the case of aluminium wires, enameled wires or wires made from hard alloys. Further, the connecting terminal according to the invention can also be used for electrical lines with small or very small cross-sections. The connecting terminal can be produced particularly beneficially due to the use of the embossing process.

In one embodiment, provision is made for the serration structures to have asymmetrical heapings of material which were produced by a lateral flow of material during the embossing process. Such heapings of material form sharp-edged structures, which simplifies penetration into hard conductor materials. Owing to the lateral flow of material brought about by the embossing process, the heapings of material come out at varying heights. This achieves a beneficial profile for the crimped connection with a conductor structure.

According to the invention, further, a method for producing an electric connecting terminal is provided in which a serration arrangement, comprising a plurality of serration structures, for cutting into an electrical conductor structure is produced in a conductor-side section of the electric connecting terminal. In this case, the serration arrangement is produced in an embossing process with a gradient-shaped sharpness profile. Owing to the use of an embossing process, heapings of material which can be used as sharp-edged structures for cutting into corresponding conductor structures can be produced particularly easily. The sharpness of the serration structures which increases in a gradient shape permits an improved connection between the terminal and the conductor structure, since the serration structures can cut in more easily and more deeply in the end section of the conductor structure than in a front conductor section.

In one embodiment, provision is made for asymmetrical heapings of material to be produced on the individual serration structures in the embossing process, which heapings of material form the gradient-shaped sharpness profile of the serration arrangement. With the aid of asymmetrical heapings of material, particularly sharp edges can be formed, which facilitates cutting into corresponding conductor structures.

In a further embodiment, provision is made for the embossing process to take place with the aid of an embossing means comprising a plurality of asymmetrical embossing structures, which means brings about a lateral flow of material in the direction of insertion of the conductor which produces the asymmetrical heapings of material of the serration structures (131, 132, 133, 134, 135, 136, 137, 138) in the conductor-side section of the connecting terminal. The desired gradient profile of the serrations can thereby be achieved in a particularly simple manner.

A further embodiment provides for the electric connecting terminal (100) to be cut out from a metal sheet (101) in a punching process, the embossing process being integrated in the punching process. The production of the connecting terminal can thereby be considerably simplified.

In a further embodiment, provision is made for a further embossing process to be carried out in which at least a part of the serration structures is cut into by means of sharp-edged knife structures in order to produce additional sharp ridges on the serration structures. Due to the splitting-up of the serration structures and the accompanying formation of sharp-edged ridges, additional relative deformations are more easily achieved upon crimping, which increases the contact stability.

According to the invention, a device for producing an electric connecting terminal is provided which comprises a punching means and a punching base. Further, the device comprises an embossing means, with the aid of which a serration arrangement, comprising a plurality of serration structures, with a gradient-shaped sharpness profile are produced in a conductor-side section of the electric connecting terminal. Serration structures can be produced in the connecting terminal very simply with the aid of the embossing means.

In one embodiment, provision is made for the embossing means to comprise a plurality of serration-shaped embossing structures with asymmetrical flanks. Serration structures with asymmetrical heapings of material can be produced with the aid of such embossing structures.

A further embodiment provides for the embossing structures to be shark-fin-shaped or sawtooth-shaped. These embossing structures are particularly well suited for producing asymmetrical heapings of material. Further, a lateral flow of material in the workpiece can be brought about particularly simply therewith, by which flow a gradient-shaped sharpness profile of the serration arrangement is formed.

In a further embodiment, the conductor-side flanks of the embossing structures are formed substantially perpendicularly. This means on one hand that the lateral flow of material induced by the embossing operation takes place particularly effectively in the desired direction. On the other hand, particularly sharp-edged heapings of material may form on perpendicular flanks, which in turn improves the properties of perforation of the relevant serrations into the conductor material.

Finally, in a further embodiment, provision is made for the embossing means to be integrated within the punching means. The integration of the embossing die in the punching die simplifies the production operation, since the punching process and the embossing process can be carried out jointly or shortly one after another.

The invention will be explained below with reference to drawings. Therein:

Figure 1:
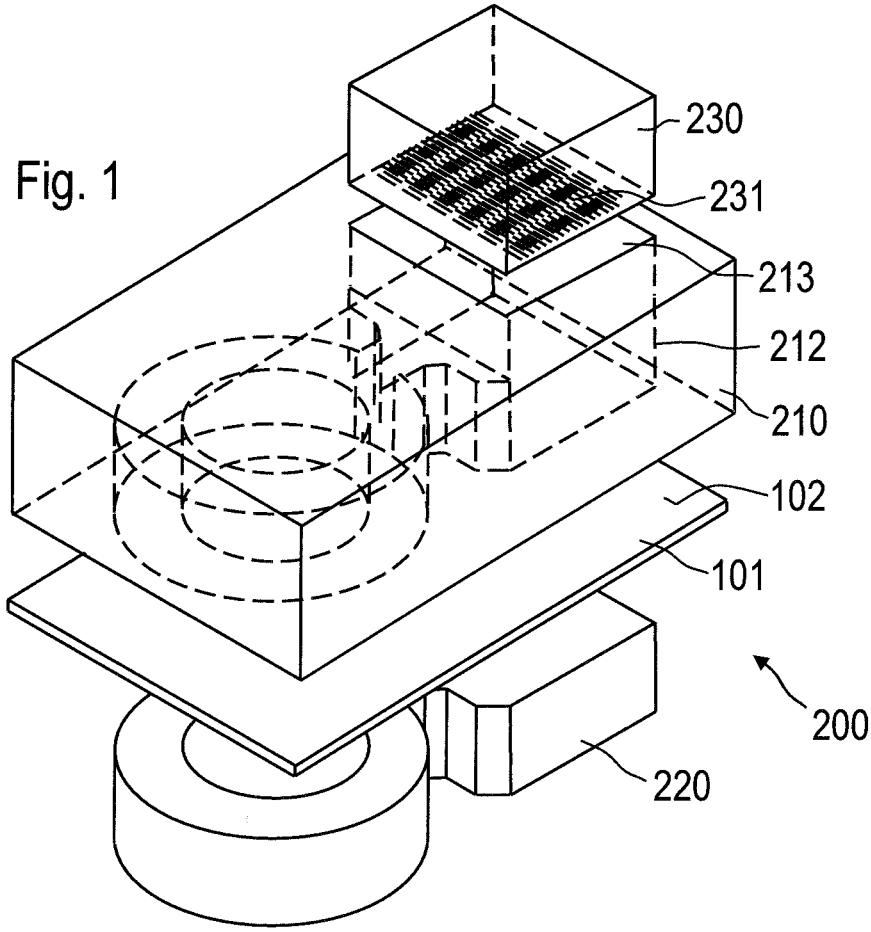
FIG. 1 shows a perspective view of a device according to the invention with a metal sheet arranged between the punching die and the punching base.

The production method for the connecting terminal according to the invention is explained in FIGS. 1 and 2 below. For this, FIG. 1 shows the starting situation for the combined punching and embossing process. Therein, a metal sheet 101 which serves as a blank is arranged between a punching die 210 which serves as a punching means and a die plate 220 which serves as a cutting base. The shape of the component to be produced is formed as a negative impression 211 in the punching die 210. The cutting base 220, in contrast, has the positive form of the component which is to be produced, so that the metal sheet 101 upon lowering of the punching die 210 is cut out along the cutting edges, which are complementary to each other, of the negative impression 211 formed in the punching die 210 and of the cutting base 220.

According to the invention, the device 200 shown in FIG. 1 further has an embossing means 230. The embossing means 230 may, as is the case here, be formed as an embossing die integrated within the punching die 210, which embossing die engages in an opening region 213 of the punching means 210. The embossing die 230 in this case comprises a plurality of embossing structures 231 which are in the form of serrations arranged in a groove shape. This is merely indicated in FIG. 1.

Owing to the integration of the embossing die 230 in the punching die 210, the embossing of the desired serration structures can take place immediately after the connecting terminal 100 has been cut out from the metal sheet 101 which serves as a blank. The embossing process can in principle also take place before the punching process.

Depending on the application, it may be advantageous to form the embossing die 230 as an embossing means which is spatially arranged separately from the punching means 210. In this case, which is not shown here, the blank 101 is transferred, after the punching, from the punching means 210 into the embossing means 230, or vice versa.

Figure 2:
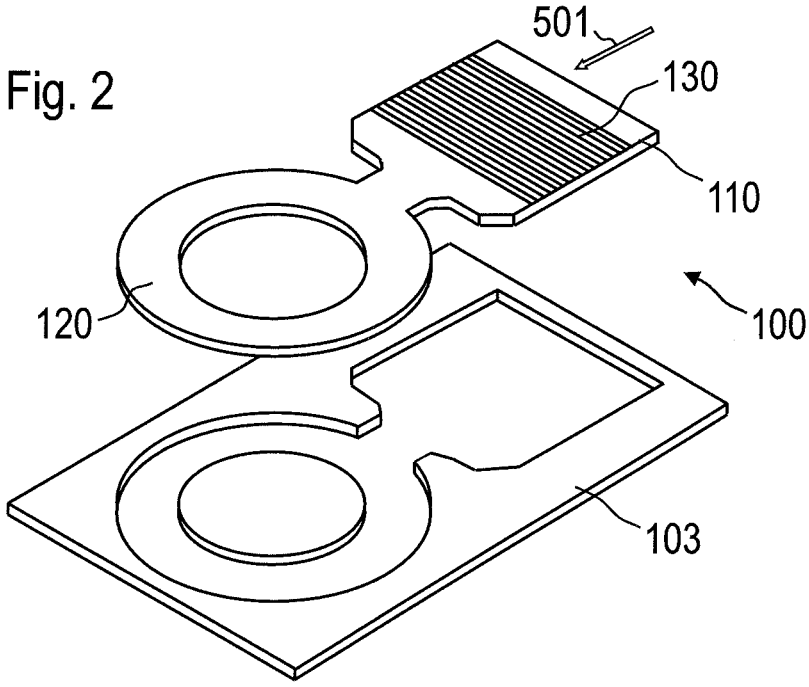
FIG. 2 shows the finished punched component with serration structures produced in an embossing process.

FIG. 2 shows the finished cut-out connecting terminal 100 which is equipped with the desired serration arrangement 130. The connecting terminal 100 in the present example comprises a conductor-side section 110 and a contact-side conductor section 120, which in the present example of embodiment is formed as a pole shoe. The two sections 110, 120 are connected together via a common bridge section.

The conductor-side section 110 has the desired serration arrangement 130, which according to the invention is constructed from groove-shaped serration structures running next to one another. The serration structures in this case extend transversely to the direction of insertion of the conductor 501, which extends parallel to the axis of symmetry of the connecting terminal 100. Although the serration structures 131 to 139 shown here extend substantially across the entire breadth of the conductor-side section 110 of the connecting terminals 100, serration structures which merely extend over part of the breadth of the section 110 are also possible, depending on the application. Further, also a plurality of serration arrangements may be arranged next to one another on the conductor-side section 110.

The punching process and the embossing process for a simple connecting terminal 100 were explained with reference to FIGS. 1 and 2. Depending on the application, the form of the connecting terminal and of the individual sections may vary. If the production of connecting terminals takes place in a mass production process, as is usually the case, it is not individual pieces of metal sheet but strip-shaped metal sheets which are used as blanks. The punching then takes place in a continuous process, the cut-out workpieces being connected together by means of thinner bridges for better handling. In the punching process, the conductor-side section 110 may already also be pre-bent in order to facilitate further steps, in particular the crimping. The punching die 210 and the cutting base 220 may be correspondingly preformed for this purpose. Depending on the respective application, a negative punching means may also be used, the punching die having the shape of the component to be produced and the cutting base serving as negative impression. Further, the punching means may also be in roller form, the punching die and cutting base being arranged on two contra-rotating rollers. This permits a continuous punching or embossing process.

Figure 3:
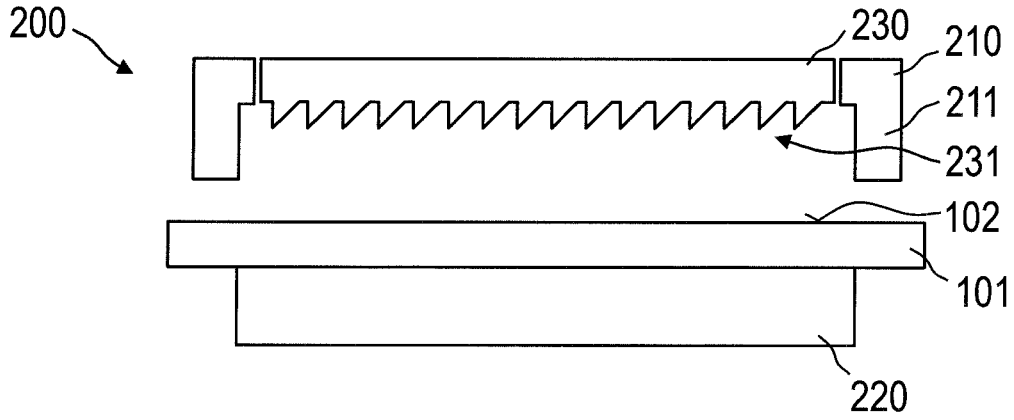
FIG. 3 shows a device according to the invention for producing a connecting terminal, comprising a punching means and an embossing means with a metal sheet arranged between the die and the punching base.
Figure 4:
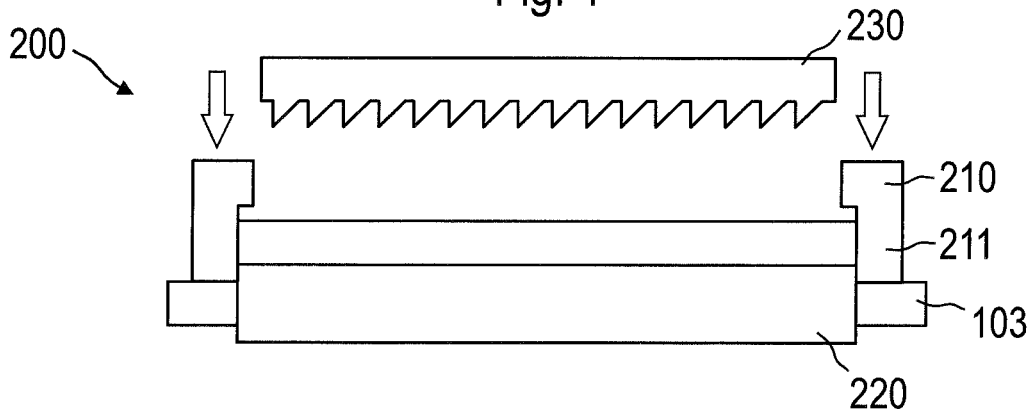
FIG. 4 shows the device of FIG. 3 during a punching operation.
Figure 5:
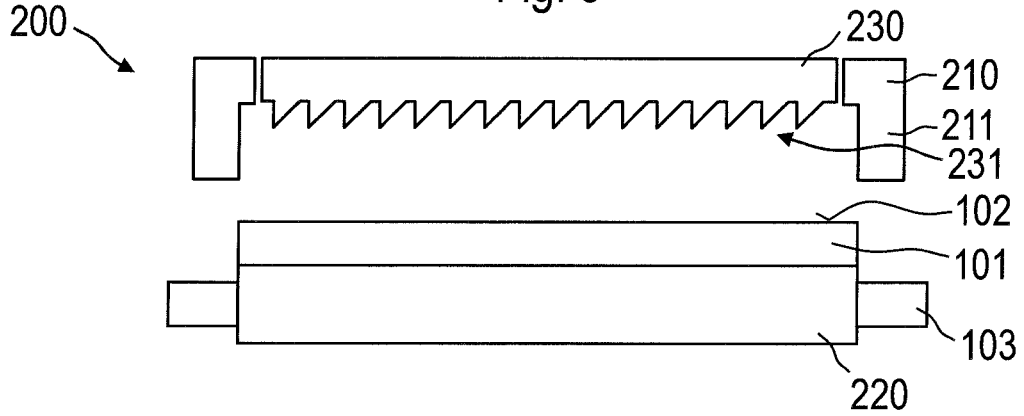
FIG. 5 shows the device of FIGS. 3 and 4 with a finished punched component.

In FIGS. 3 to 5, the punching operation and the embossing operation are illustrated in a diagrammatically simplified cross-sectional view. Therein, FIG. 3 shows the starting situation, in which the sheet metal piece 101 which serves as a blank is arranged between an upper tool part which serves as a punching die 210 with an integrated embossing die 230 and a lower tool part 220 which serves as a cutting base. In the present example of embodiment, the embossing die 230 comprises a plurality of serration-shaped embossing structures 231, which are merely indicated here for clarity. The embossing structures 231 which extend in a groove-shape have according to the invention sawtooth-shaped cross-sectional profiles with asymmetrical flanks, the left flanks in each case extending substantially perpendicularly at least over a partial region. In the following method step, the desired component is cut out from the metal sheet 101 and then the desired serration structures are embossed into the conductor contact surface 102 of the metal sheet 101. As is illustrated in FIG. 4 by means of arrows, the punching die 210 is moved in the direction of the die plate 220 for this purpose. This transfers the contour of the die plate 220 into the metal sheet. Owing to the complementary formation of the die 210 and of the cutting base 220, the lateral parts 211 of the die 210 which serve as punch knives slide along the outer periphery of the cutting base 220 and carry the excess metal sheet 103 with them.

Figure 6:
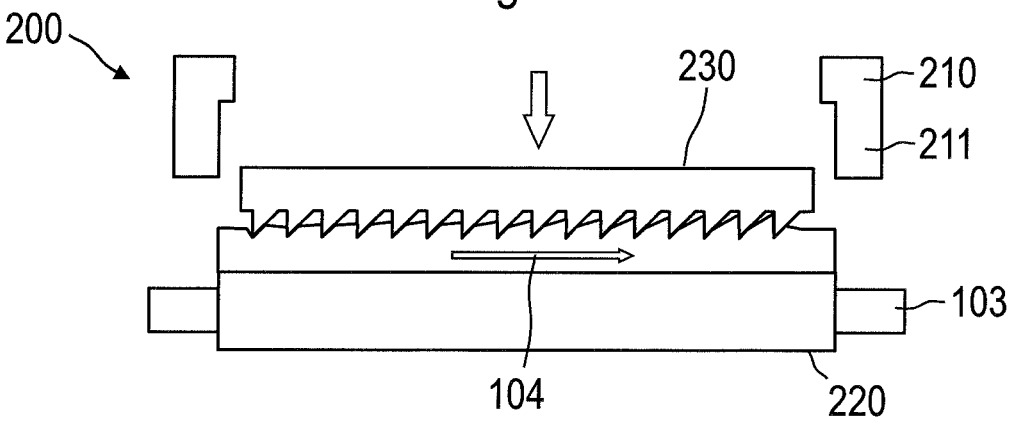
FIG. 6 shows the device of FIGS. 3 to 5 during an embossing operation in which the serration structures are produced on the component.

Once the punching process has taken place, the punching die 210 is guided upwards (FIG. 5) and then the embossing process is carried out. In so doing, the embossing die 230 is lowered onto the blank 101 such that the embossing structures during the embossing operation are pressed into the contact surface 102 of the punched connecting terminal 100. Due to the asymmetrical construction of the serration-shaped embossing structures 231, the two flanks having different angles of inclination, the material of the machined workpiece 101 is displaced to different extents by the two flanks. As shown in FIG. 6, the flatter right flank of the teeth pushes the material effectively to the right, whereas the preferably perpendicular left flank of the teeth does not cause any substantial displacement of material in the workpiece. Due to the flow of material 104 in the direction of insertion of the conductor 501 which is yielded effectively therefrom, material is pressed effectively against the steep left flank of the embossing structures and raised up on this flank. The heaping of material thus produced forms a sharp-edged ridge, the height or sharpness of which increases from left to right owing to the flow of material 104, represented by means of an arrow, in the workpiece 100.

Figure 7:
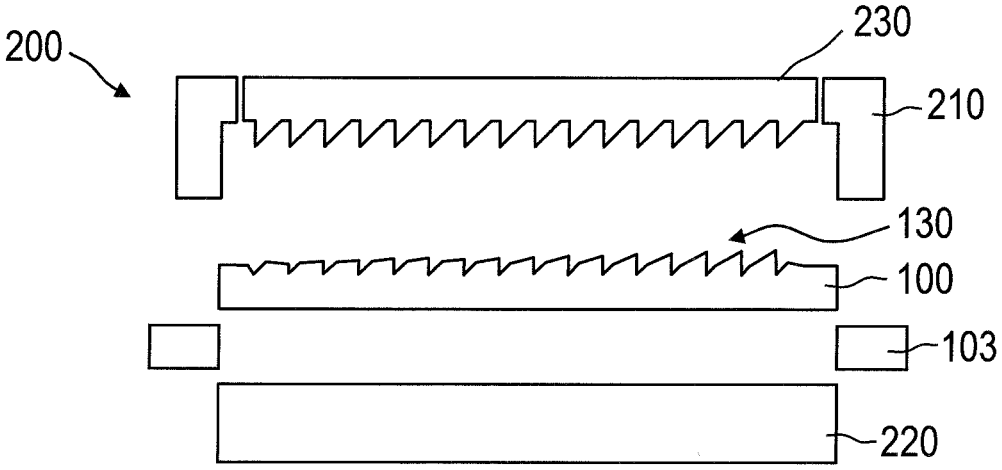
FIG. 7 shows the device of FIGS. 3 to 6 with the finished component.

Once the embossing has taken place, the embossing die 230 is raised again in order to release the finished component 100. As shown in FIG. 7, the component 100 now has the desired teeth 130 with sharper-edged serration structures increasing in a gradient shape from left to right.

Figure 8:
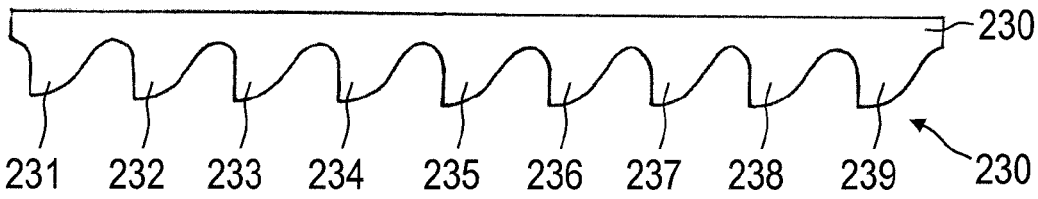
FIG. 8 shows an embossing means with a plurality of shark-fin-shaped serration structures.

The physical form of the embossing structures may vary according to the application. Thus for example embossing means with shark-fin-shaped embossing structures can also be used. FIG. 8 shows a cross-section through such an embossing means 230 as part of the die 210. As is shown here, the shark-fin-shaped embossing structures 231 to 239 also preferably have a substantially perpendicular left flank. The right flank of the embossing structures 231 to 239, on the other hand, is formed with the typical S-shaped contour. Owing to its larger displacement volume, the use of shark-fin-shaped embossing structures means that a greater flow of material can be induced in the workpiece than is the case with the aid of the wedge-shaped embossing structures shown in FIGS. 3 to 5. This opens up the possibility of adapting the flow of material to the respective application by varying the flank profile.

Figure 9:
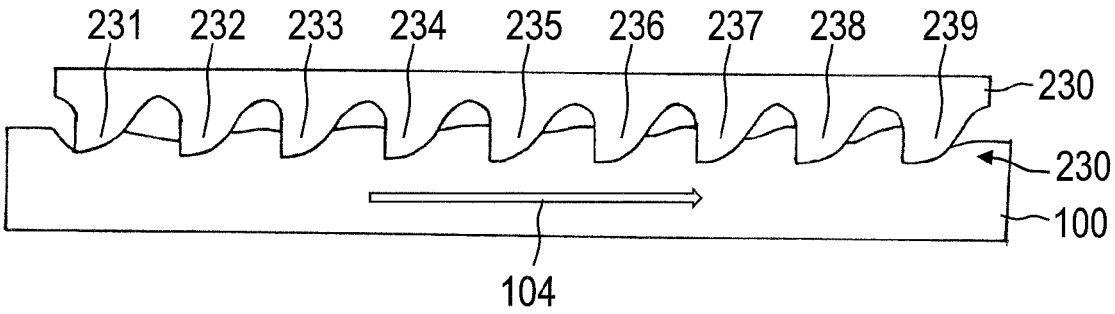
FIG. 9 shows the embossing means of FIG. 8 during the embossing operation.

As is shown in FIG. 9, a flow of material which is directed towards the right is brought about upon pressing the embossing structures 231 to 239 into the workpiece 100. This causes the material to be raised up on the steep flanks of the teeth in the interstitial spaces. Due to the flow of material, indicated by means of the arrow 104, in the workpiece 100, once the embossing process has ended, there is more material on the right side than on the left side of the workpiece 100, which means that the heapings of material on the right side are higher than on the left side.

Figure 10:
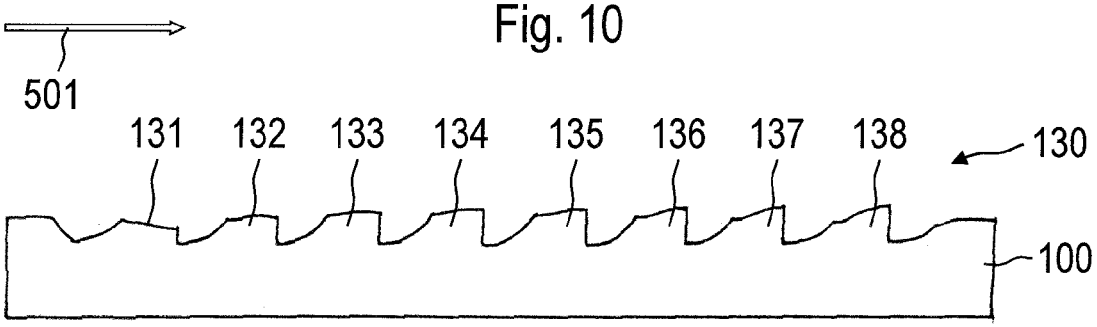
FIG. 10 shows the finished component with a number of serration structures produced by the embossing operation.

As shown in FIG. 10, the higher heapings of material of the right side also bring about a more acute or sharper profile of the relevant serration structures, since the material rises higher here. Thus the sharpness of the serration structures 131 to 138 which is achieved, and hence the sharpness profile of the serration arrangement 130, increases from left to right in a gradient shape. Upon the crimping of a connecting terminal 100 which is configured in this manner with a conductor structure, the serration structures 131, 132, 133, 134 on the conductor input side therefore penetrate only relatively slightly into the conductor core, so that the conductor structure at this point is not excessively mechanically weakened. The serration structures 131 to 134 on the conductor input side therefore contribute primarily to the mechanical fastening of the conductor structure within the connecting terminal 100, and less to the production of a sufficient electrical contact between the connecting terminal 100 and conductor structure 500. On the other hand, the contact-side serration structures 135 to 138, owing to the relatively higher heapings of material and the associated sharper-edged ridges, penetrate further into the conductor structure 500, which means that a particularly good electrical connection between the connecting terminal 100 and the conductor structure 500 can be achieved.

Figure 11:
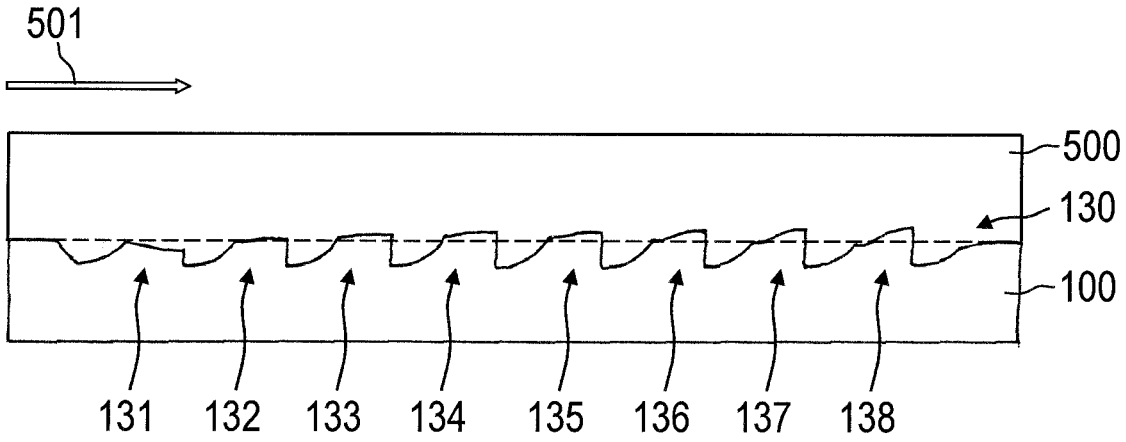
FIG. 11 shows the electric connecting terminal of FIG. 10 upon cutting into an electrical conductor structure.

In order to make clear the mode of operation of the special connecting terminal 100, FIG. 11 shows the serration arrangement 130 engaged with an electrical conductor structure 500. In this case, the original path of the conductor structure 500 is indicated by means of the broken line. As is shown here, the depth of penetration of the serration structures 131 to 138 into the relevant conductor structure 500, increases from left to right owing to the different heights of the heapings of material. In this case, dependent on the material properties of the conductor structure, more or less large amounts of conductor material may flow into the gaps in the serration structures 131 to 138 upon crimping the terminal. Particularly in the case of soft materials, virtually complete filling of the gaps may take place.

Figure 12:
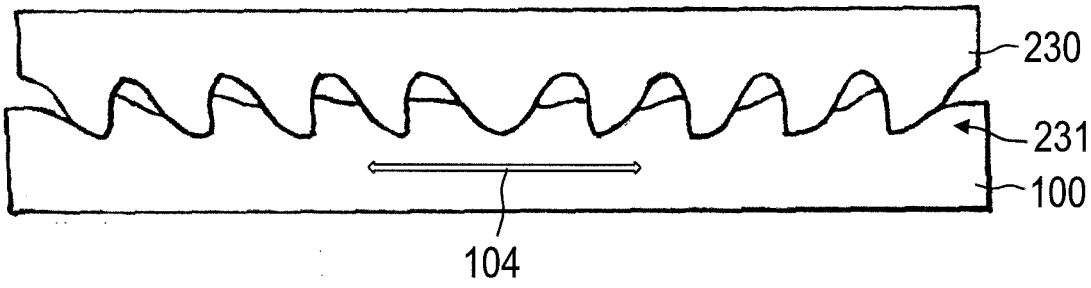
FIG. 12 shows a variation of the embossing method according to the invention for producing mirror-symmetrically arranged serration structures.
Figure 13:
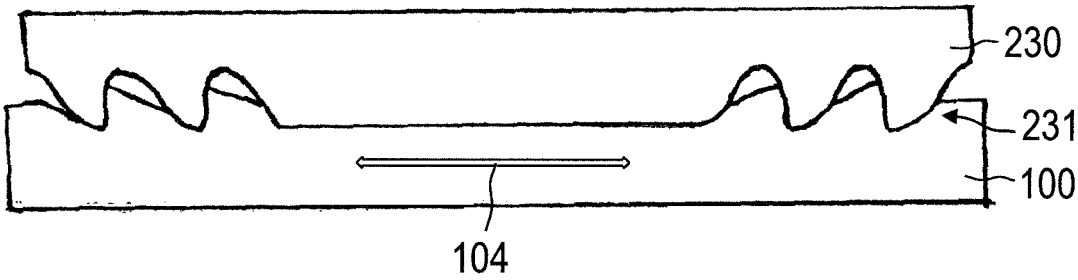
FIG. 13 shows a further variation of the embossing method according to the invention for producing mirror-symmetrically arranged serration structures and a flat middle region.

Depending on the application, a plurality of serration arrangements may also be produced. Inter alia, the serration structures of two serration arrangements may be arranged mirror-symmetrically to each other. FIG. 12 shows an embossing operation in which two serration arrangements which are mirror-symmetrical to each other are produced. On the other hand, in the example of embodiment of FIG. 13 additionally a flat region between the serration arrangements which are arranged mirror-symmetrically to each other is produced by means of a correspondingly formed embossing die 230.

Figure 14:
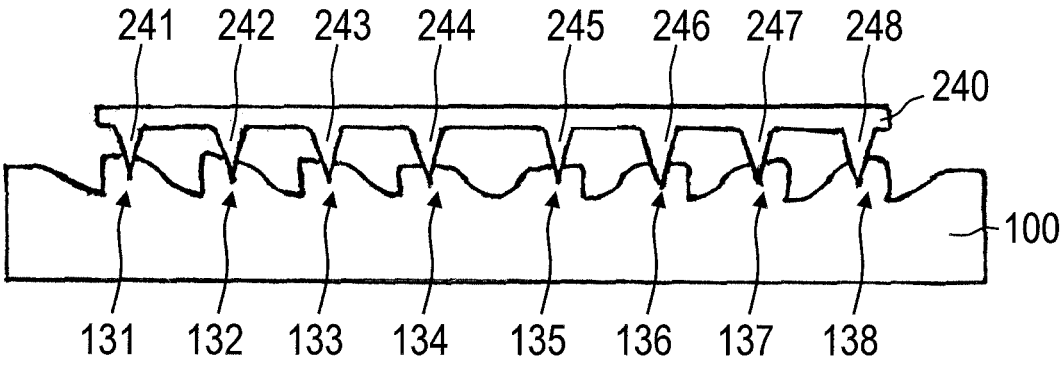
FIG. 14 shows a further embossing process, in which additional sharp ridges are produced on the serration structures by means of a second embossing die comprising a plurality of knife structures.

Since as many sharp-edged structures as possible are advantageous for producing a good electrical contact between the connecting terminal and conductor structure, the number of sharp-edged ridges can be increased by splitting up individual serration structures. This can be done for example by a second embossing operation in which an embossing die 240 equipped with a plurality of sharp, wedge-shaped blades 241, 242, 243, 244, 245, 246, 247, 248 is pressed into the previously produced serrations 131, 132, 133, 134, 135, 136, 137, 138. Such a situation is shown in FIG. 14.

The embossing according to the invention of the serration structures is achieved by a special formation of the embossing die 230 in the punching tool 200. One important prerequisite for the desired heapings of material is constituted on one hand by a sufficiently large displacement of material by the embossing/embossing removal operation (summarily), which brings about a flow of material transversely to the serration structures. On the other hand, it is advantageous if the serration structures, at least on one side, have very largely perpendicular flanks against which the transversely-flowing material can rise up. Asymmetrical ridges which are increasingly sharper in a gradient shape can be obtained particularly well on the perpendicular flanks with periodic sawtooth-like or shark-fin-like formations of the flanks of the embossing die. These are to be arranged in the crimp in particular in regions of the greatest compression.

The embodiments disclosed in the preceding description in conjunction with the figures are merely examples of embodiment of the invention. In this case, depending on the application, all the features disclosed in this connection, both individually and in combination with each other, may be relevant for realising the invention. Also, the invention is not intended to be restricted merely to the embodiments shown here. Rather, it is within the spirit of the invention to vary the number, the arrangement and the dimensions of the individual serration structures in order to permit an electrical and/or mechanical connection between the connecting terminal and conductor structure which is optimised for the requirements of the respective application.

The invention claimed is:

1. An electric connecting terminal for connecting to an electrical conductor structure, wherein a serration arrangement, comprising a plurality of serration structures formed by heapings of material produced in an embossing process, for cutting into the electrical conductor structure is provided in a conductor-side section of the electric connecting terminal, the serration structures on a contact side of the serration arrangement are formed by higher or sharper heapings of material than the serration structures on a conductor input side of the serration arrangement.

2. An electric connecting terminal according to claim 1, wherein the serration structures have asymmetrical heapings of material which were produced by a lateral flow of material during the embossing process.

3. A method for producing an electric connecting terminal, in which a serration arrangement, comprising a plurality of serration structures being formed by heapings of material produced in an embossing process, for cutting into an electrical conductor structure is produced in a conductor-side section of the electric connecting terminal, wherein the serration structures on a contact side of the serration arrangement are formed by higher or sharper heapings of material than the serration structures on a conductor input side of the serration arrangement.

4. A method according to claim 3, wherein asymmetrical heapings of material are produced on the individual serration structures in the embossing process, which heapings of material form the gradient-shaped sharpness profile of the serration arrangement.

5. A method according to claim 3, wherein the embossing process takes place with the aid of an embossing means comprising asymmetrical embossing structures, through which means a lateral flow of material in the direction of insertion of the conductor which produces the asymmetrical heapings of material of the serration structures is brought about in the conductor-side section of the connecting terminal.

6. A method according to claim 3, wherein the electric connecting terminal is cut out from a metal sheet in a punching process, the embossing process being integrated in the punching process.

7. A method according to claim 3, wherein a further embossing process is carried out in which at least a part of the serration structures is cut into by means of sharp-edged knife structures in order to produce additional sharp ridges on the serration structures.

8. A device for producing an electric connecting terminal, comprising a punching means and a punching base, wherein an embossing means is provided in order to produce a serration arrangement, comprising a plurality of serration structures being formed by heapings of material produced in an embossing process, the embossing means is configured to produce the serration structures on a contact side of the serration arrangement formed by higher or sharper heapings of material than the serration structures on a conductor input side of the serration arrangement.

9. A device according to claim 8, wherein the embossing means comprises serration-shaped embossing structures with asymmetrical flanks.

10. A device according to claim 8, wherein the embossing structures are shark-fin-shaped or sawtooth-shaped.

11. A device according to claim 8, wherein the conductor-side flanks of the embossing structures are formed substantially perpendicularly.

12. A device according to claim 8, wherein the embossing means is integrated within the punching means.

* * * * *